US005722282A

United States Patent [19]

Mine et al.

[11] Patent Number: 5,722,282

[45] Date of Patent: Mar. 3, 1998

[54] METHOD OF MANUFACTURING A CUP-SHAPED ARTICLE

[75] Inventors: Kouichi Mine, Aichi-ken; Akio Hotta, Toyota, both of Japan

[73] Assignee: Toyota Jidosha Kabushiki Kaisha, Toyota, Japan

[21] Appl. No.: 853,672

[22] Filed: May 9, 1997

Related U.S. Application Data

[63] Continuation of Ser. No. 561,244, Nov. 21, 1995, abandoned.

[30] Foreign Application Priority Data

Nov. 21, 1994 [JP] Japan ..... 6-286454

[51] Int. Cl.[6] ..... B21D 22/00; B21D 22/21; B21C 37/02

[52] U.S. Cl. ..... 72/348; 72/349; 72/379.4

[58] Field of Search ..... 72/348, 349, 358, 72/356, 359, 379.4, 354.6, 354.8, 347; 413/69

[56] References Cited

U.S. PATENT DOCUMENTS

| | | | |
|---|---|---|---|
| 2,770,034 | 11/1956 | Lyon . | |
| 2,776,475 | 1/1957 | Mapes | 72/348 |
| 2,875,511 | 3/1959 | Hawes . | |
| 2,877,546 | 6/1959 | Wilcox . | |
| 3,466,908 | 9/1969 | Whiteford | 72/348 |
| 4,129,024 | 12/1978 | Deveney . | |
| 4,339,939 | 7/1982 | Book et al. | 72/348 |
| 5,149,238 | 9/1992 | McEldowney et al. | 72/348 |
| 5,347,839 | 9/1994 | Saunders | 72/348 |

FOREIGN PATENT DOCUMENTS

| | | |
|---|---|---|
| 1 752 186 | 4/1971 | Germany . |
| 59-007430 | 1/1984 | Japan . |
| 60-102240 | 6/1985 | Japan . |
| 3-264125 | 11/1991 | Japan . |
| 5-329559 | 12/1993 | Japan . |

*Primary Examiner*—Lowell A. Larson
*Assistant Examiner*—Rodney Butler
*Attorney, Agent, or Firm*—Cushman, Darby & Cushman IP Group of Pillsbury, Madison & Sutro LLP

[57] ABSTRACT

A method for manufacturing a cup-shaped article includes making the thickness of a cylinder portion of a cup-shaped configuration uniform, between a step of drawing a flat plate material portion into a cup-shaped configuration and a step of ironing the cup-shaped configuration into a final cup-shaped article. Increasing the thickness may be performed by coining or axial compression. The thickness increasing step may be replaced by a step, provided prior to the drawing step, of providing a plate material portion having a greater thickness at a radially inner portion than at a radially outer portion.

13 Claims, 8 Drawing Sheets

| STEP | BLANK CUTTING | DRAWING | COINING | IRONING |
|---|---|---|---|---|
| |   |   |   |   |
| CLEARANCE | — | 1.10 t0 | — | — |
| IRONING RATE | — | — | — | 30 – 50% |

METHOD OF MANUFACTURING A CUP-SHAPED ARTICLE

This is a continuation of application Ser. No. 08/561,244, filed on Nov. 21, 1995, which was abandoned.

BACKGROUND OF THE INVENTION

1. Field of the Invention

The present invention relates to a method for manufacturing a cup-shaped article from a flat plate material portion by plastic forming.

2. Description of Related Art

Certain methods for manufacturing a cup-shaped article from a flat plate material portion are known.

(1) In a first conventional method, as illustrated in FIG. 19, a circular plate material 52 (seen only in cross-section here) is press-cut from a plate 51. The circular plate material 52 is then formed into a cup-shaped article 53 by drawing, using a die and a corresponding punch, without being accompanied by a forcible change in a thickness of the material.

(2) In a second conventional method, as illustrated in FIG. 21, the cup-shaped configuration 53 formed according to the above-described first method is further formed into a final cup-shaped article 54 by ironing, using a die and a corresponding punch accompanied by a forcible change in a thickness of a cylinder portion of the cup-shaped product and a simultaneously occurring elongation of the cylinder portion thereof.

Further, to prevent variance in thickness along an axial direction of the cup-shaped article during the formation thereof, the following method is described in Japanese Patent Publication No. HEI 5-329559.

A flat plate is formed into a cup-shaped configuration by drawing. The material is then ironed in a normal direction and in a reverse direction into a final cup-shaped article.

However, the above methods have the following problems, respectively.

In the first method, because a portion of the material located between a shoulder of the die and a shoulder of the punch during drawing is axially elongated and little material is supplied to that portion from a surrounding portion, part of a cylinder portion of the cup-shaped article, close to the shoulder of the punch, is reduced in thickness. In addition, because the circumferential length of a radially outward portion of the flat plate is shortened during the drawing into the cup-shaped article, part of the cylinder portion of the cup-shaped article, close to an open end of the cylinder portion, is increased in thickness. As a result, the thickness of the cup-shaped article varies significantly along the cylinder portion, as shown in FIG. 20. Therefore, the diametrical dimensional accuracy of the cup-shaped article is low.

In the second method, the ironing load varies when the cup-shaped article is ironed largely due to the variation in thickness of a cylinder portion of the cup-shaped article, as shown in FIG. 22. More particularly, elastic distortion of the die is small at an early stage of drawing, but is large at a latter stage. The change in the die distortion increases a change in thickness of the cylinder portion of the cup-shaped article, as shown in FIG. 23, and degrades the dimensional accuracy of the cup-shaped article.

In the method described in HEI 5-329559, since ironing is conducted at a low ironing rate (i.e., at a rate of 16.4%) in the normal and reverse directions, the reduced thickness portion formed during drawing cannot be completely avoided in the ironing. As a result, the dimensional accuracy of the cylinder portion of the cup-shaped article, close to its bottom, is low.

SUMMARY OF THE INVENTION

An object of the invention is to provide a method for manufacturing a cup-shaped article from a flat plate material portion by plastic forming, which can significantly improve a diametrical dimensional accuracy.

A method in accordance with the present invention includes the steps of: drawing a flat plate material portion into a first cup-shaped configuration having a cylinder portion with a reduced thickness portion and a bottom portion; forming said first cup-shaped configuration into a second cup-shaped configuration having a cylinder portion with a substantially uniform thickness over its entire length and a bottom portion, by increasing the thickness of the reduced thickness portion of the cylinder portion of the first cup-shaped configuration; and forming the second cup-shaped configuration into a final cup-shaped article by ironing the cylinder portion of the second cup-shaped configuration.

The above thickness increasing step may be eliminated by providing, before the drawing step, a step of manufacturing a circular flat material portion having a radially inner portion and a radially outer portion, with the radially inner portion having a greater thickness than the radially outer portion.

BRIEF DESCRIPTION OF THE DRAWINGS

The above and other objects, features, and advantages of the present invention will become more apparent and will be more readily appreciated from the following detailed description of the preferred embodiment of the present invention in conjunction with the accompanying drawings, in which.

DETAILED DESCRIPTION OF THE PREFERRED EMBODIMENTS

Figure 12:
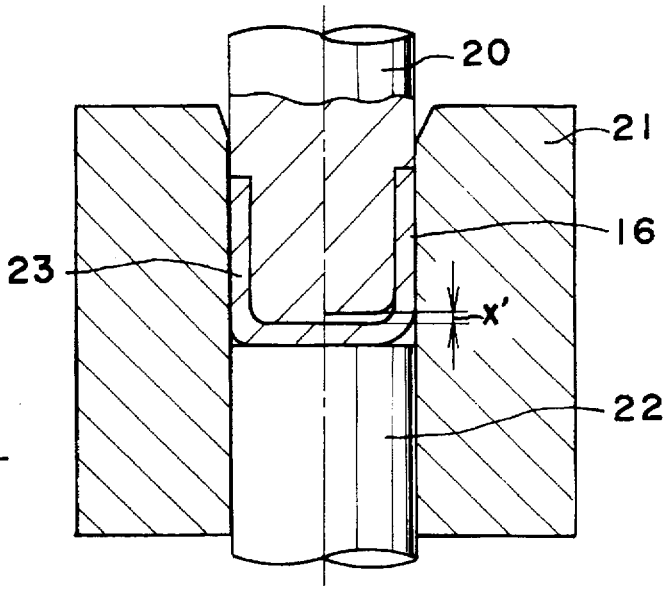
FIG. 12 is a cross-sectional view of an apparatus for performing a thickness increasing step in a method for manufacturing a cup-shaped article in accordance with a second embodiment of the present invention.
Figure 13:
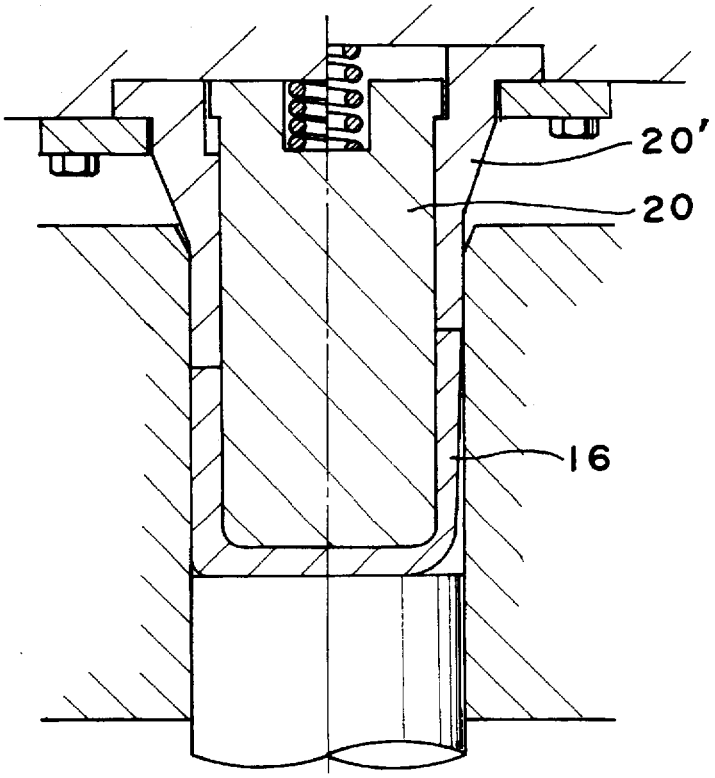
FIG. 13 is a cross-sectional view of an apparatus for performing a thickness increasing step in a method for manufacturing a cup-shaped article in accordance with a third embodiment of the present invention.

FIGS. 1–11 illustrate a method in accordance with a first embodiment of the present invention. FIG. 12 illustrates an apparatus in accordance with a second embodiment of the present invention. FIG. 13 illustrates an apparatus in accordance with a third embodiment of the present invention. FIGS. 14–18 illustrate aspects of a method in accordance with the fourth embodiment of the present invention. Throughout all of the embodiments of the present invention, portions common to all of the embodiments are denoted with the same reference numerals.

Firstly, portions common to all of the embodiments of the present invention will be explained with reference to FIGS. 1–11.

Figure 1:
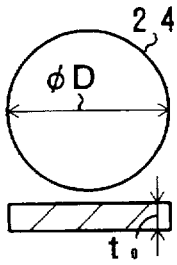
FIG. 1 is a diagram illustrating the steps for manufacturing a cup-shaped article in accordance with a first embodiment of the present invention.
Figure 1:
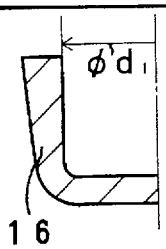
Figure 1:
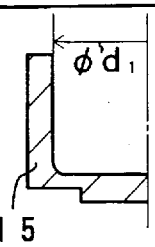
Figure 1:
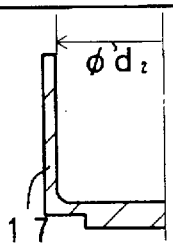

As illustrated in FIG. 1, a method for manufacturing a cup-shaped article 17, in accordance with the present invention, includes drawing a flat plate material portion 24 into a first cup-shaped configuration 16 having a cylinder portion with a decreasing thickness therealong and a bottom portion. The first cup-shaped configuration 16 is then formed into a second cup-shaped configuration 15, having a cylinder portion with a substantially uniform thickness therealong and a bottom portion, by increasing a thickness of the reduced thickness portion of the cylinder portion of the first cup-shaped configuration 16 through plastic working. Finally, the second cup-shaped configuration 15 is formed into a final cup-shaped article 17 by ironing the cylinder portion of the second cup-shaped configuration 15. The method for manufacturing a cup-shaped article 17 may include a step of providing a circular and substantially flat material portion 24 having a substantially uniform thickness, prior to the drawing step. The above-described thickness increasing step may be omitted when a flat plate material portion 25, 26, which is thicker at a radially inner portion thereof compared to a radially outer portion, is used as the flat plate material portion for the drawing step. The plastic working step includes coining or axial compression.

In the present invention, a thickness increasing step is provided between the drawing step and the ironing step, or a flat plate material portion 25, 26 which is thicker at a central portion than a peripheral portion is used for the drawing step.

Figure 2:
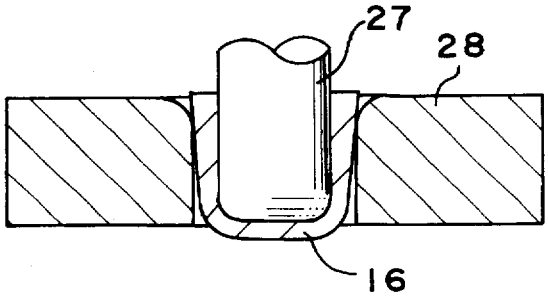
FIG. 2 is a cross-sectional view of a drawing apparatus and a first cup-shaped configuration during a drawing step.

In the drawing step, as illustrated in FIG. 2, the flat plate material portion 24 is drawn by a punch 27 and a die 28 into the cup-shaped configuration 16. A clearance between the punch 27 and the die 28 is greater than a thickness of the flat plate material portion 24, so that the flat plate material portion 24 is not ironed during the drawing process. For example, the punch 27 and the die 28 have a clearance therebetween equal to about 1.1 times a thickness of the flat plate material portion 24. The first cup-shaped configuration 16 thus drawn, as shown in FIG. 1, has a relatively small thickness at a portion of the cylinder portion close to the bottom portion, and a relatively large thickness at a portion of the cylinder portion close to its open end. Therefore, a diametrical dimensional accuracy of the first cup-shaped configuration 16 is low.

In the thickness increasing step, a part of the cylinder portion is moved or shifted to the reduced thickness portion (the portion of the cylinder portion close to the bottom portion) from a surrounding portion by plastic working, so that the cylinder portion of the second cup-shaped configuration 15 has a substantially uniform thickness along its entire length. This material shift is effected by coining in the first embodiment of the present invention, and by axial compression in the second and third embodiments of the present invention.

Figure 4:
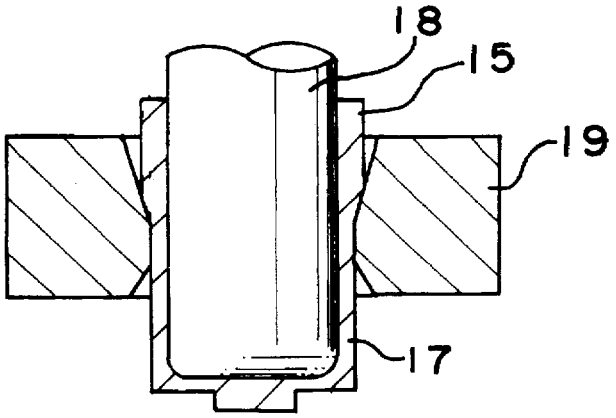
FIG. 4 is a cross-sectional view of an ironing apparatus and a cup-shaped final article during the ironing step.
Figure 5:
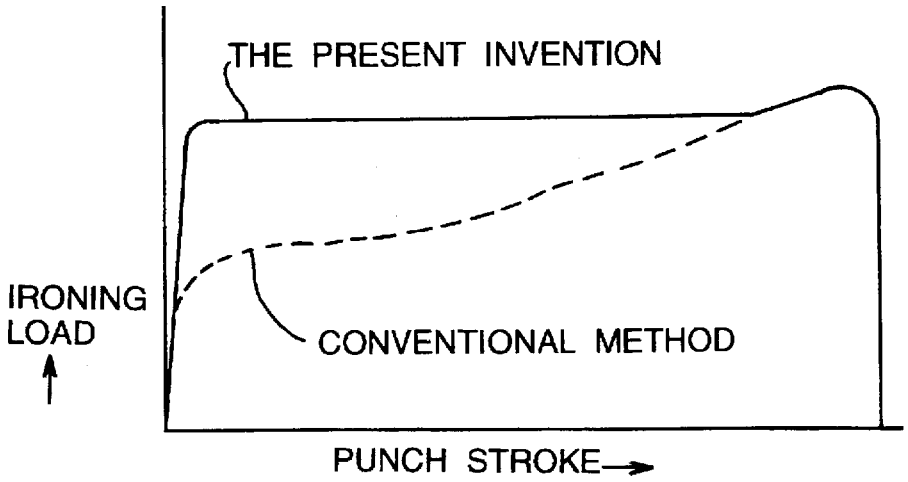
FIG. 5 is a graph illustrating a relationship between an ironing load and a stroke of the punch during the ironing step, according to the present invention, where a curve according to a conventional method is also shown for comparison with the present invention.
Figure 6:
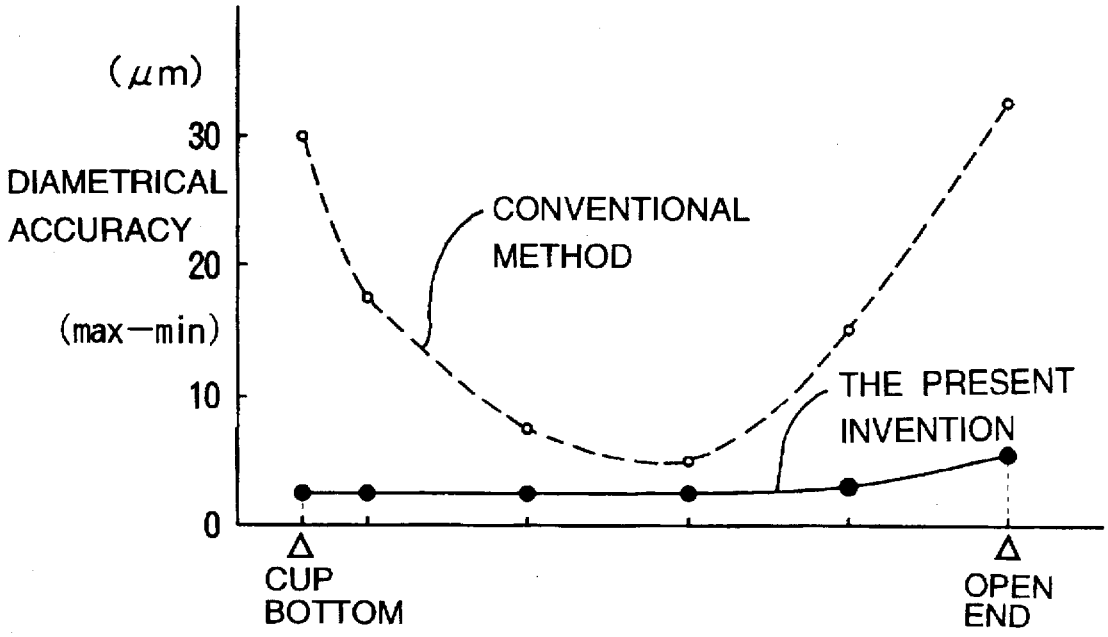
FIG. 6 is a graph showing variations in the diameter dimension along the cylinder portion of the second cup-shaped configuration after the coining step, according to the present invention, where a curve according to a conventional method is also shown for comparison.

In the ironing step, as illustrated in FIG. 4, the second cup-shaped configuration 15 is ironed by a punch 18 and a die 19 into a final cup-shaped article 17. The cup-shaped article 17 has a decreased thickness and an increased length. A clearance between the punch 18 and the die 19 is smaller than a thickness of the cylinder portion of the second cup-shaped configuration 15. An ironing rate (i.e., thickness reduction rate) is selected to be between about 30–50%. Because the thickness of the cylinder portion of the second cup-shaped configuration 15 is substantially uniform due to the thickness increasing process, the ironing load is substantially distributed over the entire stroke of the punch, as shown in FIG. 5, so that elastic distortion of the die is generally constant. Due to this stable ironing load, diametrical dimensional accuracy after the ironing step is very high, as shown in FIG. 6. For example, diametrical dimensional variance of the cup-shaped article 17 manufactured according to the present invention is less than 3 microns, while that of a product manufactured according to the conventional method is as much as 30 microns.

Next, portions unique to each embodiment of the present invention will be explained.

Figure 3:
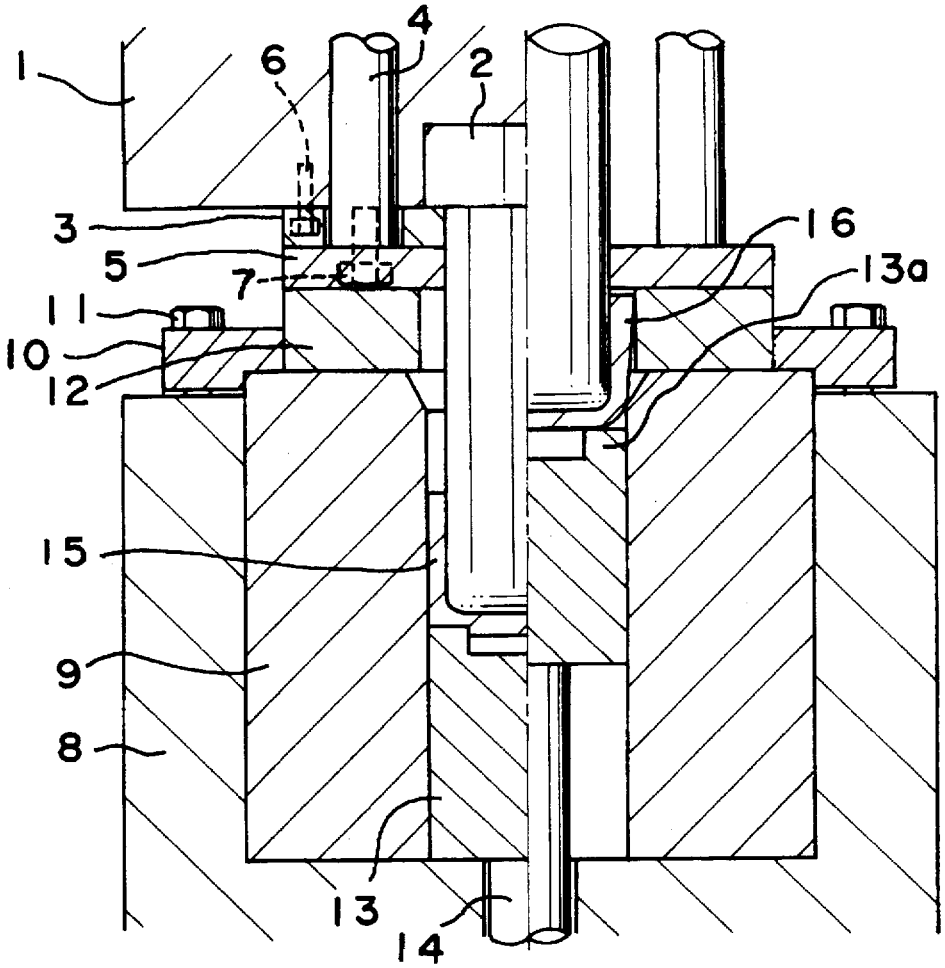
FIG. 3 is a cross-sectional view of a coining apparatus and a second cup-shaped configuration during a coining step.

In the first embodiment of the present invention, as illustrated in FIG. 3, coining applied to the bottom portion of the first cup-shaped configuration 16 is used to increase the thickness of the reduced thickness portion of the cylinder portion of the first cup-shaped configuration 16. A right half of FIG. 3 illustrates a state before coining and a left half of FIG. 3 illustrates a state after coining. More particularly, an upper die 1 is coupled to a press ram (not shown), and the punch 2 is fixed to the upper die by, for example, a retainer 3 and bolts 6. An ejecting rod 4 is provided for ejecting the formed second cup-shaped configuration 15 from the punch 2. The rod 4 is biased by, for example, a hydraulic cylinder, an air cylinder, or a spring (not shown) to push the second cup-shaped configuration 15 toward a tip of the punch 2 via a plate 5 coupled to an end of the rod 4.

A lower die 8 is coupled to a bed (not shown) of the press machine. A generally cylindrical guide 9 is fit in a guide mounting hole formed in the lower die 8, and a lower punch 13 for coining is slidably fit within the cylindrical guide 9. The guide 9 is fixed to the lower die 8 by, for example, a retainer 10 and bolts 11. A material guide 12 is also fit in the retainer 10. The lower punch 13 is moved by a lower rod 14. The lower rod 14 is driven by, for example, a hydraulic cylinder or an air cylinder (not shown). The lower punch 13 may be biased upwardly by means of a spring, urethane rubber, or a belleville spring.

The first cup-shaped configuration 16 is set in the material guide 12. At this stage, the lower punch 13 is raised to a position shown in the right half of FIG. 3. When forming is performed, the first cup-shaped configuration 16 is squeezed between the upper punch 2 and the lower punch 13, and is lowered, restricted by an inside surface of the guide 9, until the lower punch 13 comes into interference with the lower die 8. The bottom portion of the first cup-shaped configuration 16 is coined by a protrusion **13*a* formed in the lower punch 13. The coined wall portion is moved toward the reduced thickness portion of the cylinder portion of the first cup-shaped configuration 16, so that the first cup-shaped configuration 16 is plastically formed into the second cup-shaped configuration 15** having a cylinder portion with substantially uniform thickness.

Figures 7, 8, 9:
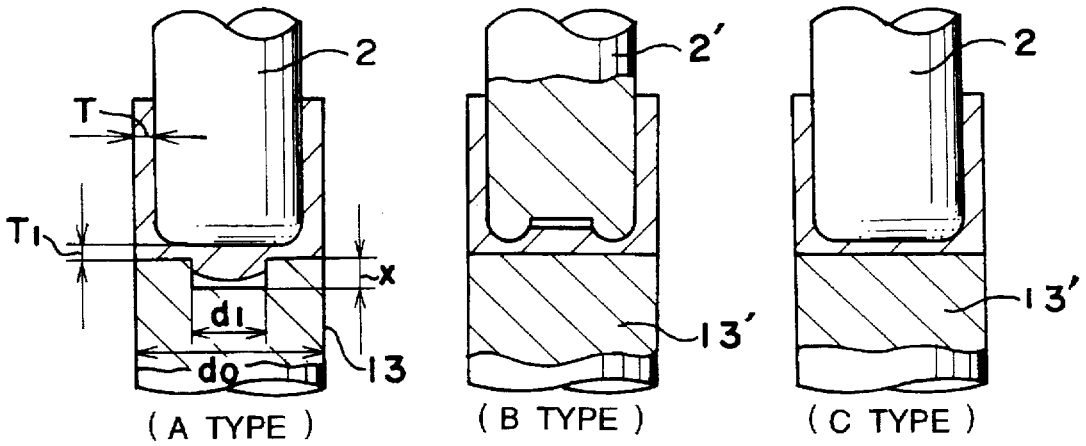
FIG. 7 is a partial cross-sectional view of a pair of upper and lower punches used for coining.
FIG. 8 is a partial cross-sectional view of another pair of upper and lower punches which can be used for coining, replacing the punches of FIG. 7.
FIG. 9 is a partial cross-sectional view of yet another pair of upper and lower punches which can be used for coining, replacing the punches of FIG. 7.

FIGS. 7, 8 and 9 illustrate some preferred configurations of punches for coining.

The punches of FIG. 7 (A type) include a lower punch 13 having a concave for receiving a portion of the shifted wall material therein at a central portion of the punch 13. In FIG. 7, the lower punch 13 having an outside diameter $d_0$ has a concave having diameter $d_1$, and depth x.

The punches of FIG. 8 (B type) include an upper punch 2' having a concave for receiving a portion of the shifted wall material therein at a central portion of the punch 2'.

The punches of FIG. 9 (C type) include an upper punch 2 and a lower punch 13' each having flat end surfaces.

Figure 11:
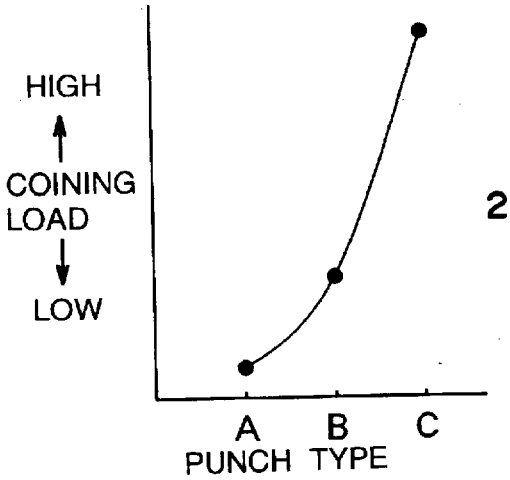
FIG. 11 it is a graph illustrating a relationship between a magnitude of coining load versus the configurations of the punches of FIGS. 7 to 9, respectively.

As seen in FIG. 11, the coining load is relatively low using A and B types, which are preferable in terms of length of functional life and a forming energy.

Figure 10:
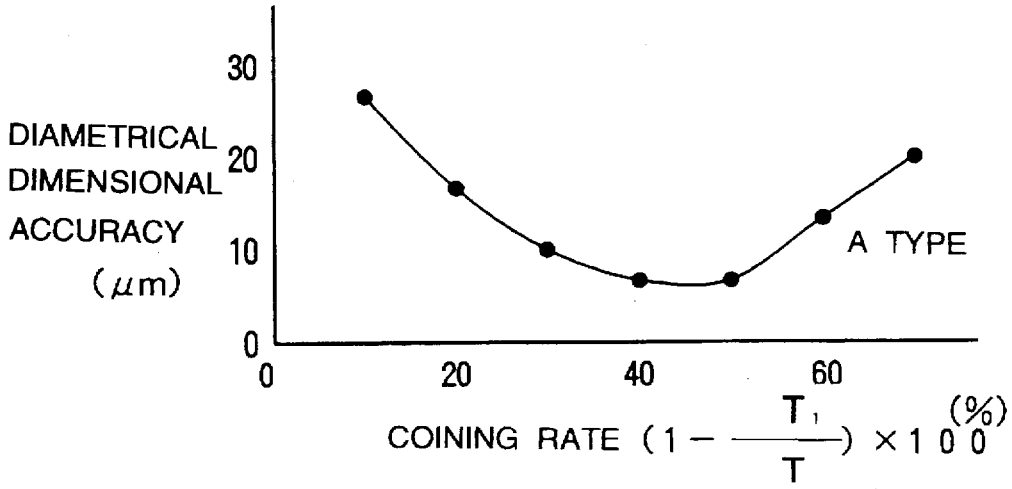
FIG. 10 is a graph illustrating a relationship between diametrical dimensional accuracy of a cylinder portion of a cup-shaped article and a coining rate of a bottom portion thereof, where coining is conducted using the punches of FIG. 7.

FIG. 10 illustrates a relationship between the diametrical dimensional accuracy of the cylinder portion of the second cup-shaped configuration 15 and the coining rate of the bottom portion of the second cup-shaped configuration when the coining is performed using the punches of FIG. 7. In this instance, coining rate is defined as $(1-T_1/T)\times 100\%$, where $T_1$ is a thickness of a radially outer portion of the bottom portion after coining and T is a thickness of the radially outer portion of the bottom portion before coining which is equal to a thickness of the cylinder portion (see FIG. 7). As seen from FIG. 10, the diametrical dimensional accuracy of the cylinder portion of the second cup-shaped configuration 15 is greatly improved at coining rates of about 30% to about 50%.

Coining may be performed as a last stage of the drawing step, whereby the manufacturing cycle time period can be shortened and the press machine can be compact. Further, coining may be performed any time before ironing.

In the second embodiment of the present invention, as illustrated in FIG. 12, axial compression applied to the cylinder portion of the first cup-shaped configuration 16 is used as the form of plastic working to increase the thickness of the reduced thickness portion of the cylinder portion of the first cup-shaped configuration 16. More particularly, the first cup-shaped configuration 16 is set in a die 21 and is then compressed with a punch 20 having a stepped portion at a side surface thereof. This is a buckling forming with a buckling amount x', as seen in FIG. 12. The buckling starts at the reduced thickness portion, where a clearance between the first cup-shaped configuration 16 and the die 21 is large. At a final stage of the buckling, all portions of the clearance between the first cup-shaped configuration 16 and the die 21 is filled with a shifted portion of the wall material, so that the first cup-shaped configuration 16 is plastically formed into the second cup-shaped configuration 15 having a cylinder portion with a substantially uniform thickness therealong.

In the third embodiment of the present invention, as illustrated in FIG. 13, axial compression is applied to the cylinder portion of the first cup-shaped configuration 16, as in the second embodiment of the present invention. However, in the third embodiment, in order to suppress a large change in the thickness of the bottom portion of the first cup-shaped configuration 16, the upper punch is divided into two portions, i.e., a main body 20 and a sleeve 20'. The bottom portion of the first cup-shaped configuration 16 is first squeezed by the main body 20 and the lower punch. The cylinder portion of the first cup-shaped configuration 16 is then axially compressed by the sleeve 20'. By way of this axial compression, the height of the final article is stabilized.

In the fourth embodiment of the present invention, as illustrated in FIGS. 14–18, a method for manufacturing a cup-shaped article 17 includes a step, prior to the drawing step, of manufacturing a circular flat plate material portion 29 which is thicker at a radially inner portion thereof than at a radially outer portion thereof. Then, the plate material portion 29 is drawn into a cup-shaped configuration 15. The cup-shaped configuration 15 is then ironed into a final cup-shaped article 17. According to this method, coining and axial compression to increase the reduced thickness portion of the cylinder portion are not necessary, so that it is possible to reduce the cost of the final article.

In the flat plate material portion manufacturing step, a thickness ratio between a portion of the flat plate material portion 29 corresponding to the cylinder portion of the cup-shaped configuration 15 and a portion of the flat plate material portion 29 corresponding to the bottom portion of the cup-shaped configuration 15 is determined so that, after drawing, the cylinder portion of the cup-shaped configuration 15 has a substantially uniform thickness over its entire axial length.

Figure 14:
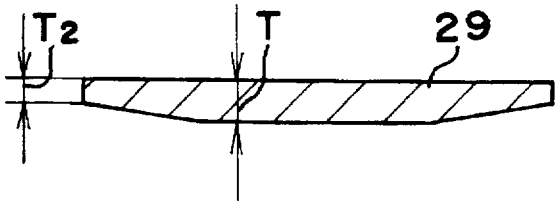
FIG. 14 is a cross-sectional view of a flat plate material portion which is used in a method for manufacturing a cup-shaped article in accordance with a fourth embodiment of the present invention.
Figure 15:
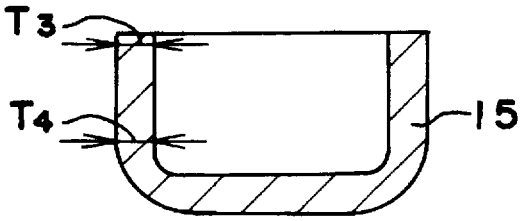
FIG. 15 is a cross-sectional view of a cup-shaped configuration formed by drawing the flat plate material shown in FIG. 14.
Figure 16:
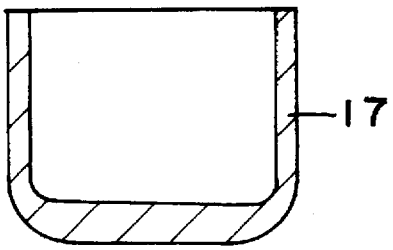
FIG. 16 is a cross-sectional view of a cup-shaped article formed by ironing the cup-shaped configuration of FIG. 15.

FIG. 14 illustrates the flat plate material portion 29, wherein its greatest thickness T is at the central portion thereof, which gradually decreases in thickness toward a radially outward edge of the plate to the smallest thickness $T_2$. When this plate 29 is drawn into the cup-shaped configuration 15, thickness $T_3$ at the open end of the cylinder portion of the cup-shaped configuration 15 will be substantially equal to thickness $T_4$ at a portion of the cylinder portion close to the bottom portion, as shown in FIG. 15. As a result, when the cup-shaped configuration 15 is subsequently ironed, the ironing load will be constant along the cylinder portion. Therefore, as shown in FIG. 16, a cup-shaped article 17 having a high diametrical dimensional accuracy is obtained.

Figure 17:
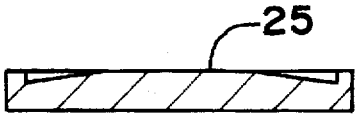
FIG. 17 is a cross-sectional view of a flat plate material portion which is formed by coining a plate and which can be used in the method in accordance with the fourth embodiment of the present invention.
Figure 18:
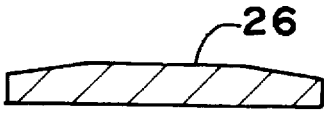
FIG. 18 is a cross-sectional view of a flat plate material portion which is formed by pressing a plate and can be used in the method in accordance with the fourth embodiment of the present invention.
Figure 19:
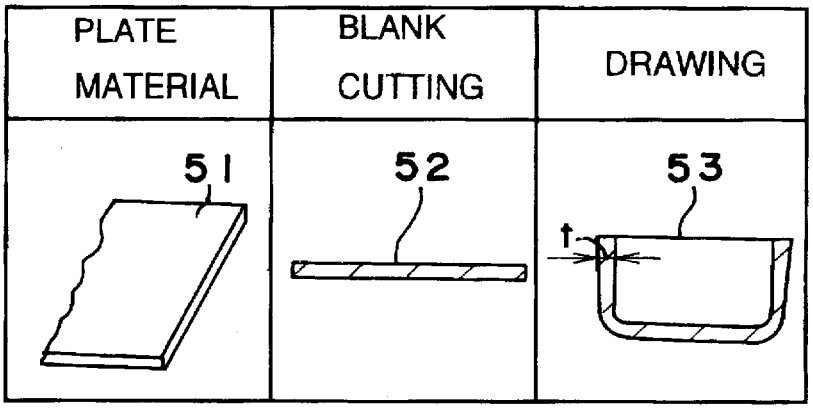
FIG. 19 (PRIOR ART)
FIG. 19 is a diagram illustrating steps of a conventional method for manufacturing a cup-shaped article by drawing.
Figure 20:
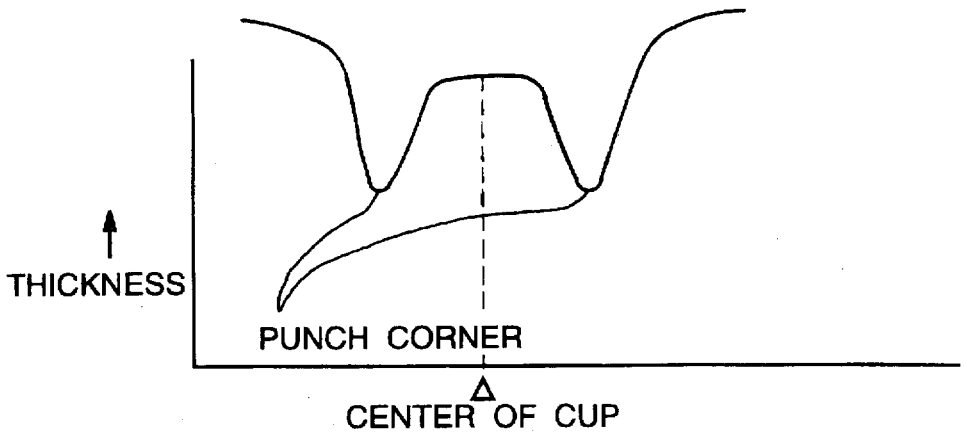
FIG. 20 (PRIOR ART)
FIG. 20 is a graph illustrating a thickness distribution of the cup-shaped article formed in accordance with the conventional steps illustrated in FIG. 19.
Figure 21:
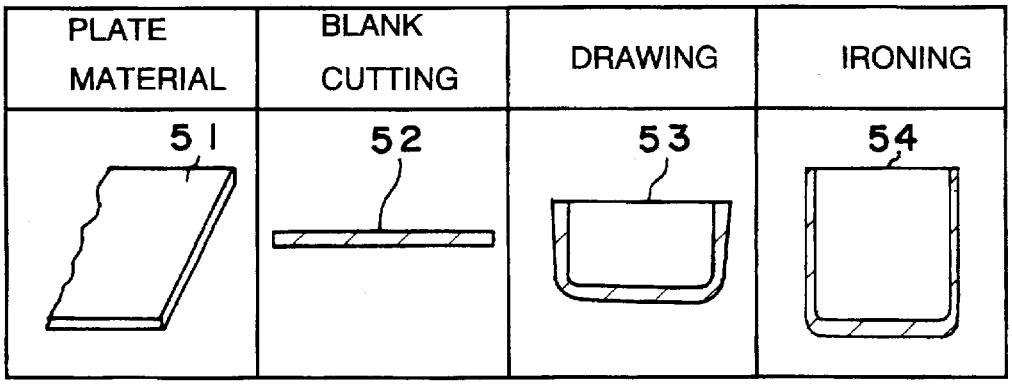
FIG. 21 (PRIOR ART)
FIG. 21 is a diagram illustrating steps of another conventional method for manufacturing a cup-shaped article by drawing and ironing.
Figure 22:
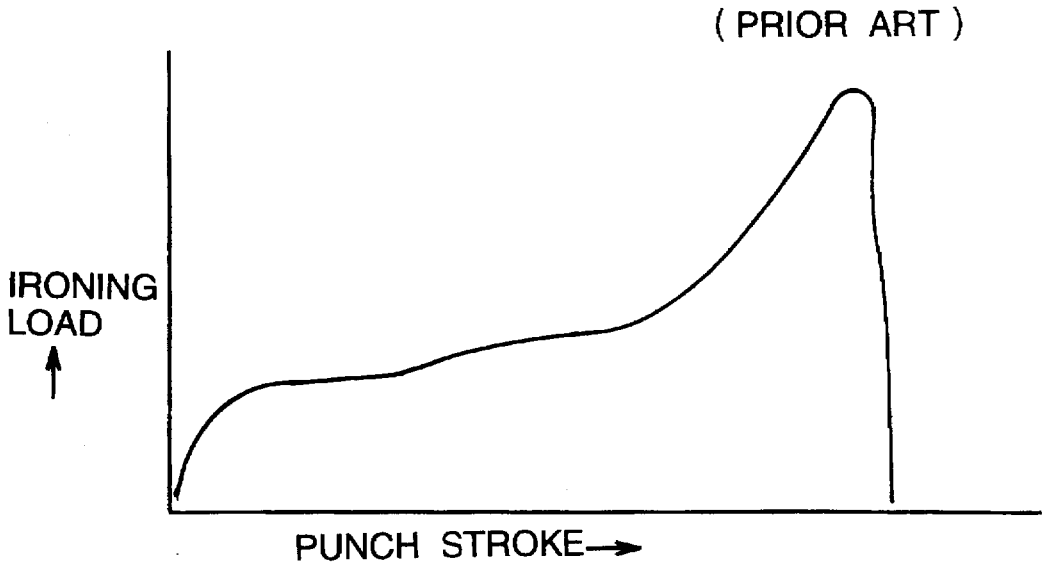
FIG. 22 is a graph illustrating a relationship between an ironing load and a punch stroke during the ironing step illustrated in FIG. 21.
Figure 23:
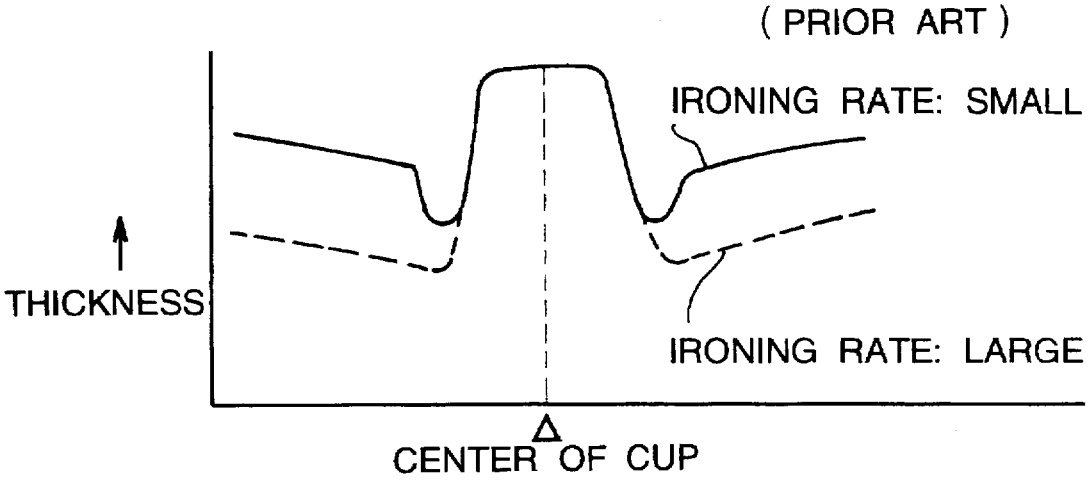
FIG. 23 is a graph illustrating a thickness distribution of the cup-shaped article formed by the conventional method of FIG. 21.

The variable thickness flat plate may be a plate 25 manufactured by coining a flat plate, as shown in FIG. 17, or it may be a plate 26 manufactured by pressing a flat plate, as shown in FIG. 18.

According to the present invention, the following advantages are obtained:

First, because a thickness increasing step is provided between the drawing step and the ironing step, the second cup-shaped configuration 15 has a uniform thickness along its cylinder portion. Therefore, the ironing load is constant along the cylinder portion and distortion of the die is uniform. As a result, the diametrical dimensional accuracy of the final cup-shaped article 17 is greatly improved.

Second, when the thickness is increased by coining, some of the material at the bottom of the first cup-shaped configuration 16 can be effectively shifted to the reduced thickness portion of the cylinder portion of the first cup-shaped configuration 16.

Third, when the thickness is increased by applying an axial compression to the cylinder portion of the first cup-shaped configuration 16, the thickness of the cylinder portion is made uniform over an entire length thereof. Further, the axial length of the cylinder portion can be adjusted.

Last, if a step of manufacturing a plate 29 having a greater thickness at a radially inner portion than at a radially outer portion is provided prior to the drawing step, a cup-shaped configuration having a substantially uniform thickness over an entire length of its cylinder portion can be obtained after drawing, without needing a thickness increasing step. As a result, a lower cost for manufacturing the cup-shaped article 17 is realized.

Although the present invention has been described with reference to specific exemplary embodiments, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A method for manufacturing a cup-shaped article, comprising the steps of:

drawing a substantially flat plate material portion into a first cup-shaped configuration having an axis, a cylindrical wall portion, and a closed bottom portion, wherein said cylindrical wall portion has a thickness which tapers in an axial direction;

forming a second cup-shaped configuration by plastically working a portion of said first cup-shaped configuration, such that said cylindrical wall portion is given a substantially uniform thickness along said axial direction by being supplied with material from said bottom portion to substantially an entire axial portion of said cylindrical wall portion having said tapering thickness in said first cup-shaped configuration; and ironing said cylindrical wall portion of said second cup-shaped configuration with a substantially constant ironing load throughout an entire axial length of said second cup-shaped configuration so as to obtain a cup-shaped article including a wall portion having a substantially uniform thickness thinner than said thickness of said wall portion of said second cup-shaped configuration.

2. A method according to claim 1, wherein said step of plastically working a portion of said first cup-shaped configuration comprises coining said closed bottom portion of said first cup-shaped configuration.

3. A method according to claim 1, further comprising a step of providing a circular and substantially flat material portion having a substantially uniform thickness, prior to said drawing step.

4. A method according to claim 1, wherein said step of drawing is performed using a punch and a die having a clearance therebetween equal to about 1.1 times a thickness of said flat plate material portion.

5. A method according to claim 1, wherein said step of ironing is performed at a rate between about 30% and about 50%.

6. A method for manufacturing a cup-shaped article, comprising the steps of:

providing a circular material portion having (a) an inner, central part having a uniform thickness and (b) an outer part having a first peripheral part and a second part which is connected to said central part, said outer part gradually decreasing in thickness from said second part to said first part throughout an entire radial length of said outer part, said central part being thicker than said peripheral part;

drawing said material portion into a cup-shaped configuration having an axis, a wall portion having a substantially uniform thickness along an axial direction throughout an entire axial length of said wall portion, and a closed bottom portion; and ironing said wall portion of said cup-shaped configuration with a substantially constant ironing load throughout said entire axial length of said wall portion, thereby obtaining a cup-shaped article including a wall portion having a substantially uniform thickness thinner than said thickness of said wall portion of said cup-shaped configuration.

7. A method according to claim 6, wherein said step of providing a circular material portion includes selecting a thickness ratio between said central part and said radially peripheral part such that, after said drawing step and before said ironing step, said wall portion of said cup-shaped configuration has a substantially uniform thickness along said axial direction.

8. A method according to claim 6, wherein said step of providing a circular material portion includes a step of coining a substantially flat circular material portion.

9. A method according to claim 6, wherein said step of providing a circular material portion includes a step of pressing a substantially flat circular material portion.

10. A method for manufacturing a cup-shaped article comprising the steps of:

drawing a substantially flat plate material portion into a first cup-shaped configuration having an axis, a cylindrical wall portion, and a closed bottom portion, wherein said cylindrical wall portion has a thickness which tapers in an axial direction;

forming a second cup-shaped configuration by plastically working a portion of said first cup-shaped configuration, such that said cylindrical wall portion is given a substantially uniform thickness along said axial direction throughout an entire axial length of said cylindrical wall portion by applying a compressive force to said cylindrical wall portion to change a thickness of substantially an entire axial part of said cylindrical wall portion; and ironing said cylindrical wall portion of said second cup-shaped configuration with a substantially constant ironing load throughout said entire axial length of said wall portion of said second cup-shaped configuration so as to obtain a cup-shaped article including a wall portion having a substantially uniform thickness thinner than said thickness of said wall portion of said second cup-shaped configuration.

11. A method according to claim 10, wherein said step of applying an axial compressive force is performed without applying a compressive force to said closed bottom portion.

12. A method according to claim 10, wherein said step of applying an axial compressive force is performed while applying a compressive force to said closed bottom portion.

13. A method according to claim 12, wherein said step of applying a compressive force to said closed bottom portion comprises squeezing said closed bottom portion between a pair of punches.

* * * * *